US006467936B1

(12) United States Patent
Golemba

(10) Patent No.: US 6,467,936 B1
(45) Date of Patent: Oct. 22, 2002

(54) ADJUSTABLE DESK LAMP

(76) Inventor: Andrew J. Golemba, W64 N625 Hanover Ave., #210, Cedarburg, WI (US) 53012

( * ) Notice: Subject to any disclaimer, the term of this patent is extended or adjusted under 35 U.S.C. 154(b) by 0 days.

(21) Appl. No.: 09/970,109

(22) Filed: Oct. 3, 2001

(51) Int. Cl.[7] ..... F21S 8/08
(52) U.S. Cl. ..... 362/413; 362/275; 362/427
(58) Field of Search ..... 362/269, 275, 362/285, 287, 401, 410, 413, 414, 418, 419, 427

(56) References Cited

U.S. PATENT DOCUMENTS 4,819,138 A * 4/1989 Polick ..... 362/427
5,016,153 A * 5/1991 Gismondi et al. ..... 362/413
5,101,332 A * 3/1992 Hsia ..... 362/410

* cited by examiner

*Primary Examiner*—Y. My Quach-Lee
(74) *Attorney, Agent, or Firm*—Donald J. Ersler

(57) ABSTRACT

An adjustable desk lamp preferably includes a base, light ballast, adjustable height support, at least one support tube, and at least one support band. The adjustable height support extends from a top of the base. One end of the at least one support tube is attached to the base and the other end is attached to the light ballast. One end of the at least one support band is attached to the base and the other end is also attached to the light ballast. The at least one support band is supported by an end of the adjustable height support. The light ballast preferably includes a base ring, rotary guide, rotary light support, and ballast assembly. The rotary light support is attached to the rotary guide and rotably constrained by the base ring. The ballast assembly is pivotally retained by the rotary guide and the rotary light support. A light bulb is retained in the ballast assembly. The height of the light ballast relative to a desk surface may be adjusted by raising or lowering the adjustable height support. The projection angle of the light bulb may be adjusted by sliding the ballast assembly relative to the rotary guide.

17 Claims, 5 Drawing Sheets

ADJUSTABLE DESK LAMP

BACKGROUND OF THE INVENTION

1. Field of the Invention

The present invention relates generally to desk lamps and more specifically to an adjustable desk lamp which allows three dimensional positioning of the light without moving the base thereof.

2. Discussion of the Prior Art

There are numerous designs of desk lamps. However, it appears that no desk lamp exists which allows three dimensional positioning of the light ballast, nor allows the projection angle of the light to be varied.

Accordingly, there is a clearly felt need in the art for an adjustable desk lamp which provides the flexibility of three dimensional positioning of the light ballast with the capability to vary the projection angle of the light.

SUMMARY OF THE INVENTION

The present invention provides an adjustable desk lamp which allows flexible light projection adjustment. The adjustable desk lamp preferably includes a base, light ballast, adjustable height support, at least one support tube, and at least one support band. The base preferably includes a bottom portion and a top portion. The top portion is pivotally attached to the bottom portion. The adjustable height support extends from the base. One end of the at least one-support tube is pivotally attached to the base and the other end is preferably pivotally attached to the light ballast.

The one end of the at least one support tube may be rigidly attached to the base and the other end rigidly attached to the light ballast which would eliminate the need for the at least one support band and the adjustable height support. One end of the at least one support band is attached to the base and the other end is attached to the light ballast. Substantially a middle of the at least one support band is supported by an end of the adjustable height support.

The light ballast preferably includes a base ring, rotary guide, rotary light support, and ballast assembly. A pivot bracket is pivotally attached to a perimeter of the base ring. The at least one support tube and the at least one support band are attached to the pivot bracket. The rotary guide is pivotally engaged with an inner diameter of the base ring. A top of the rotary light support is attached to a bottom of the rotary guide. The ballast assembly is vertically supported by the rotary light support and retained by the rotary guide. The ballast assembly includes a knob, shaft, rotary ball, light socket, and light bulb. The light bulb is attached to the light socket. The rotary ball is adjacent the light socket and the shaft extends from the rotary ball, opposite the light socket. The knob is attached to the shaft and engaged with a slot in the rotary guide. The electrical cord may be routed through the shaft and further routed through the at least one support tube and the base.

The height of the light ballast relative to a desk surface may be adjusted by raising or lowering the adjustable height support. The light ballast will retain the same angle relative to the desk surface regardless of the height thereof is adjusted to. The projection angle of the light bulb may be adjusted by sliding the ballast assembly relative to the rotary guide and by rotating the rotary guide relative to the base ring.

Accordingly, it is an object of the present invention to provide an adjustable desk lamp with a light that may be three dimensionally positioned.

Finally, it is another object of the present invention to provide an adjustable desk lamp with a light that may be angularly adjusted.

DETAILED DESCRIPTION OF THE PREFERRED EMBODIMENTS

Figure 1:
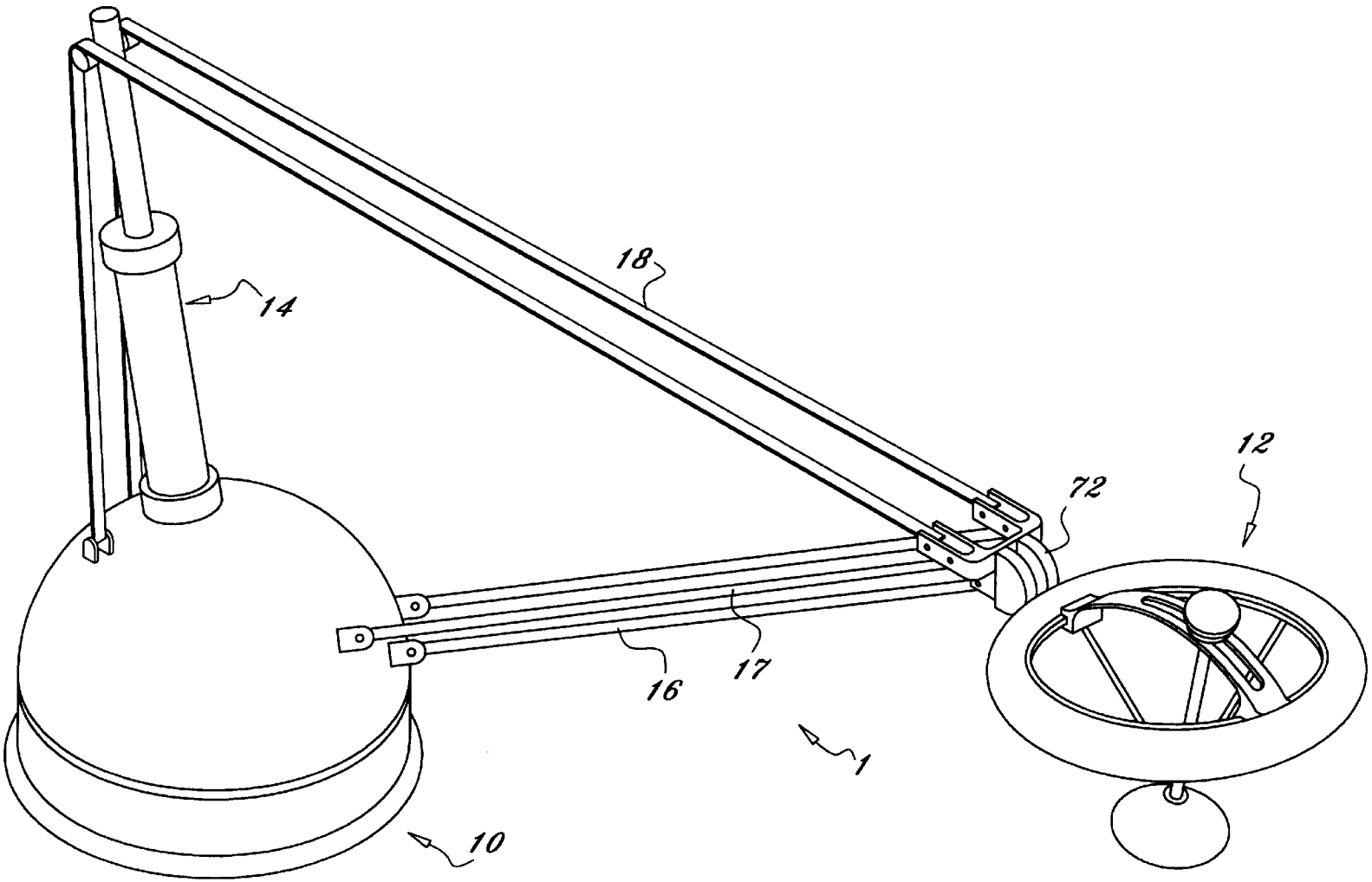
FIG. 1 is a perspective view of an adjustable desk lamp in accordance with the present invention.
Figure 2:
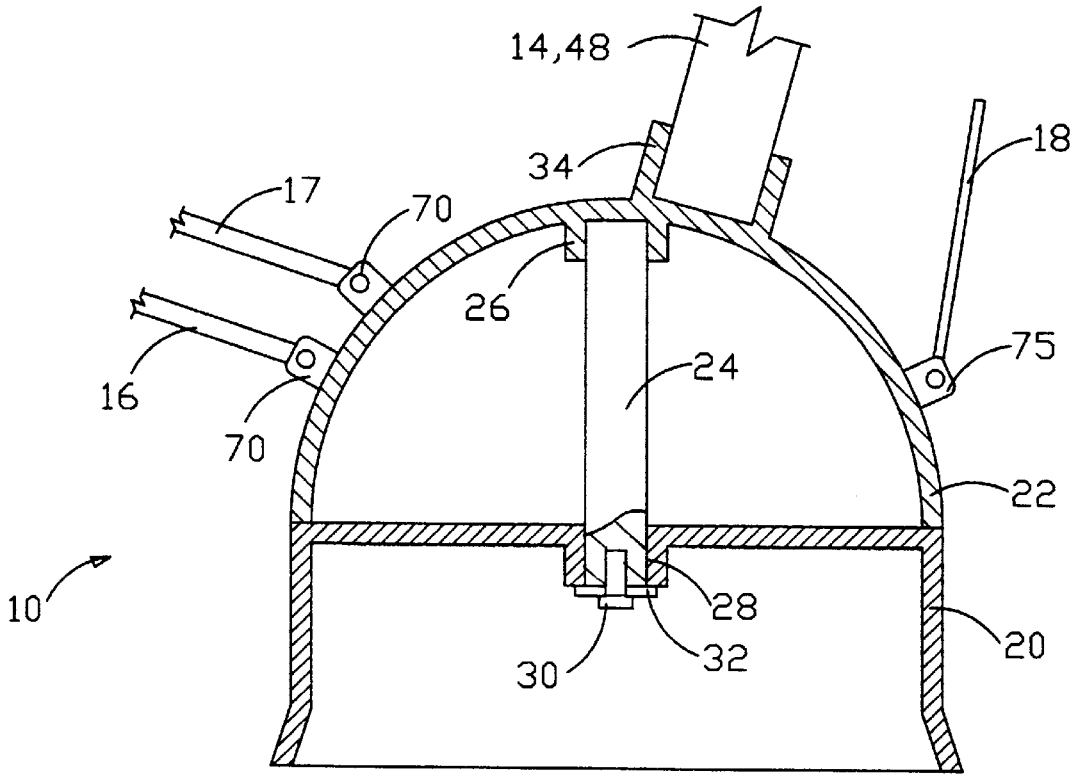
FIG. 2 is a cross sectional view of a base of an adjustable desk lamp in accordance with the present invention.

With reference now to the drawings, and particularly to FIG. 1, there is shown a perspective view of an adjustable desk lamp 1. The adjustable desk lamp 1 preferably includes a base 10, light ballast 12, adjustable height support 14, at least one support tube 16, and at least one support band 18. With reference to FIG. 2, the base 10 preferably includes a bottom portion 20 and a top portion 22. The top portion 22 is preferably pivotally attached to the bottom portion 20. A pivot pin 24 is retained in a pivot boss 26 formed on a bottom of surface of the top portion 22. A pivot bore 28 is formed in a top of the bottom portion 20. The pivot bore 28 is sized to rotably receive the pivot pin 24. A threaded fastener 30 and washer 32 are preferably used to retain the top portion 22 relative to the bottom portion 20.

Figure 3:
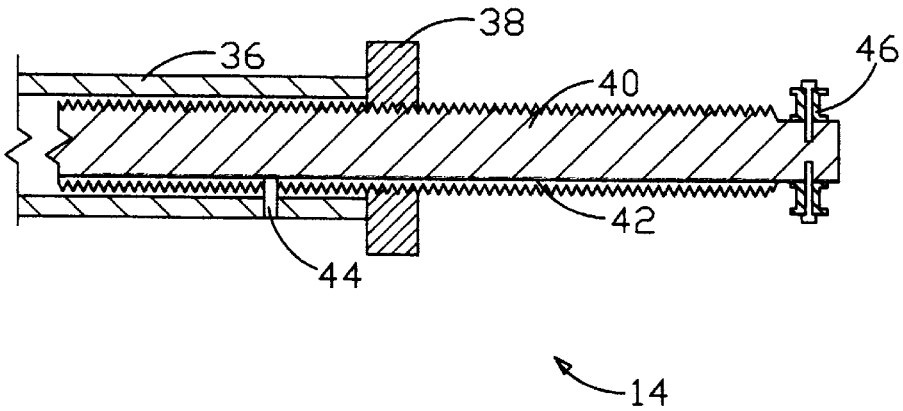
FIG. 3 is an enlarged cross sectional view of an adjustable height support of an adjustable desk lamp in accordance with the present invention.

The adjustable height support 14 is preferably retained in a support boss 34 formed on a top of the top portion 22. With reference to FIG. 3, the adjustable height support 14 includes a base tube 36, threaded ring 38, and height tube 40. The base tube 36 is retained by the support boss 34. The outside diameter of the height tube 40 is threaded to receive the threaded ring 38. A bore in the base tube 36 is sized to slidably receive the height tube 40. Rotation of the threaded ring 38 will change the height of the height tube 40 relative to the base tube 36. The height tube 40 is preferably prevented from rotating relative to the base tube 36; a slot 42 is formed in the height tube 40 and a pin 44 is inserted through a wall of the base tube 36 such that the pin 44 engages the slot 42. At least one band pulley 46 is pivotally attached to a top of the height tube 40.

Figure 4:
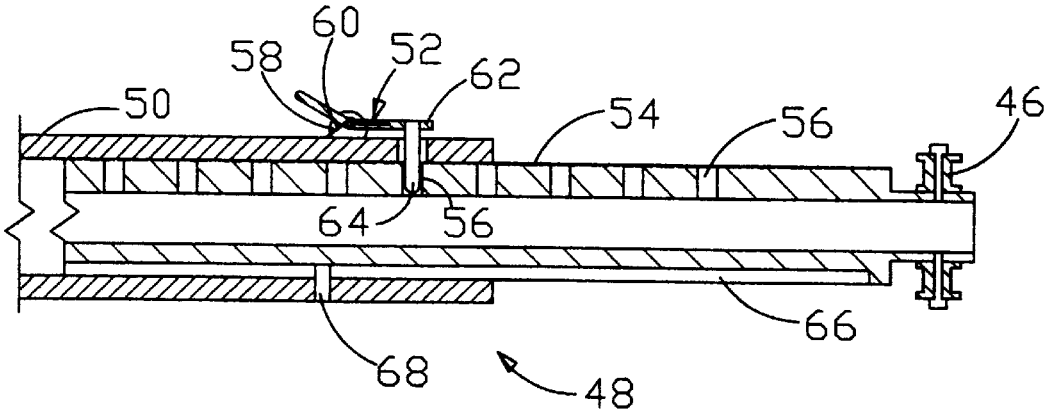
FIG. 4 is an enlarged cross sectional view of a second embodiment of an adjustable height support of an adjustable desk lamp in accordance with the present invention.

With reference to FIG. 4, a second embodiment of an adjustable height support 48 includes a base tube 50, pin catch 52, and height tube 54. The base tube 50 may be retained by the support boss 34. A bore in the base tube 50 is sized to slidably receive the height tube 54. A plurality of holes 56 are formed along a length of the height tube 54. The pin catch 52 includes a lever yoke 58, a torsion spring 60, release lever 62, and retention pin 64. The lever yoke 58 extends from the base tube 50. The lever yoke 58 is formed on the base tube 50 with any suitable manufacturing process.

Figure 5:
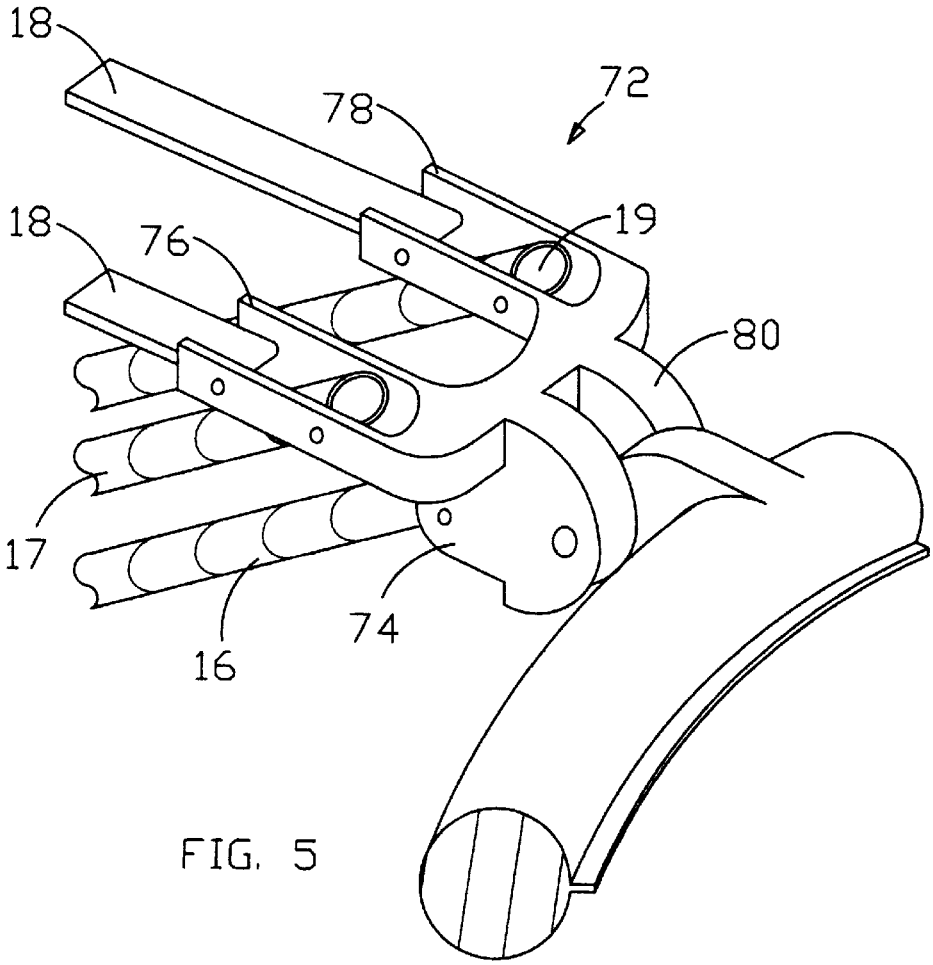
FIG. 5 is an enlarged perspective view of a pivot bracket of an adjustable desk lamp in accordance with the present invention.

The release lever 62 is pivotally attached to the lever yoke 58. The retention pin 64 extends from an end of the release lever 62. The torsion spring 60 urges the retention pin 64 toward the base-tube 50. The height tube 54 is preferably prevented from rotating relative to the base tube 50; a slot 66 is formed in the height tube 54 and a pin 68 is inserted through a wall of the base tube 50 such that the pin 68 engages the slot 66. At least one band pulley 46 is pivotally attached to a top of the height tube 54. To raise the height tube 54, the release lever 62 is rocked back and the height tube 54 moved to the desired height such that the retention pin 64 may be engaged into one of the holes 56. Two embodiments of adjustable height supports have been shown and described. However, the design of the adjustable height support should not be limited The adjustable desk lamp 1 preferably includes three support tubes 16 and two support bands 18. One end of a first support tube 16 is pivotally attached to a base tube yoke 70 formed on a top of the top portion 22. With reference to FIG. 5, a pivot *bracket 72 preferably includes a tube yoke 74, a first tube/band yoke 76,. a second tube/band yoke 78, and a ballast yoke 80. The other end of the first support tube 16 is preferably pivotally attached to the tube yoke 74. The other end of the first support tube 16 may also be rigidly attached to the tube yoke 74. One end of a second support tube 17 is pivotally attached to a single base tube yoke 70. One end of the third support tube 19 is pivotally attached to a single base tube yoke 70 (not shown). The other end of the second support tube 17 is pivotally attached to a first tube/band yoke 76 and the other end of the third support tube 19 is pivotally attached to a second tube/band yoke 78. The second and third support tubes may also be rigidly attached to the pivot bracket 72. One end of the at least one support band 18 is attached to a band yoke 75 and the other end is also attached to one of the tube/band yokes. Substantially a middle of one of the at least one support bands 18 is supported by a single band pulley 46. Other support devices may be substituted for the at least one support tube.

Figure 6:
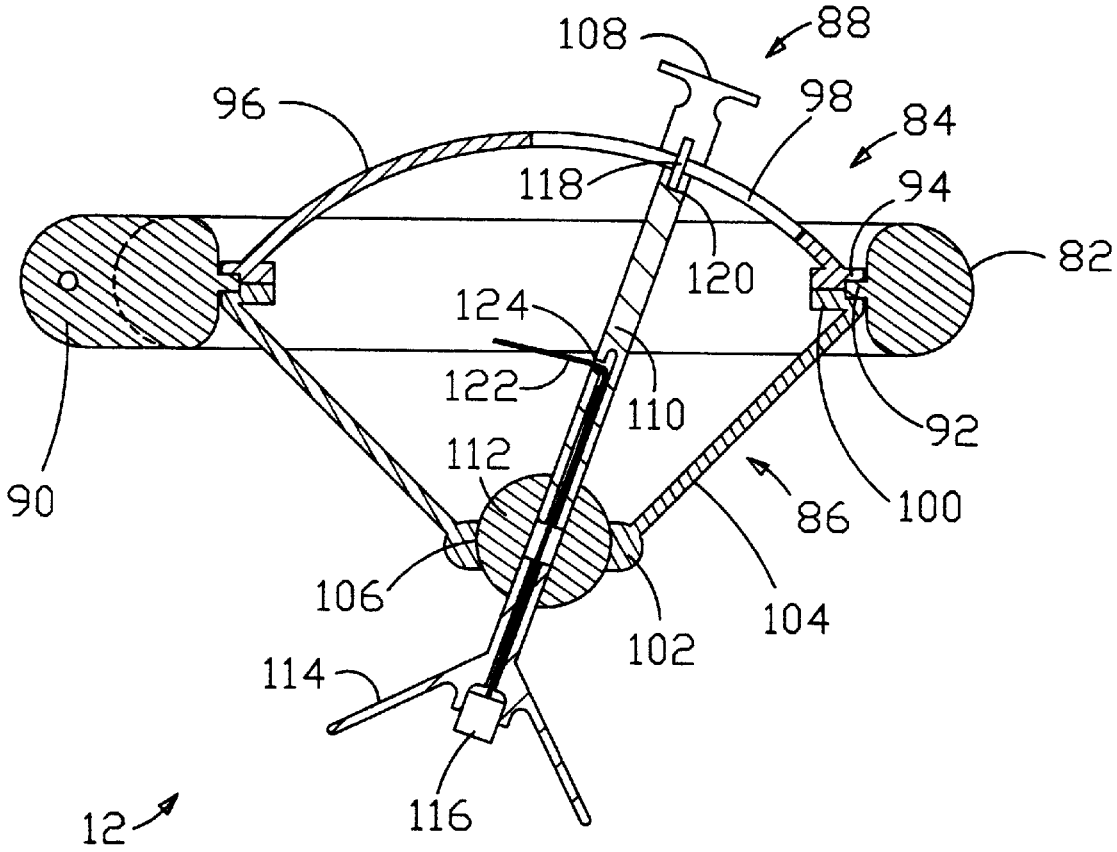
FIG. 6 is a cross sectional view of a light ballast of an adjustable desk lamp in accordance with the present invention.
Figure 7:
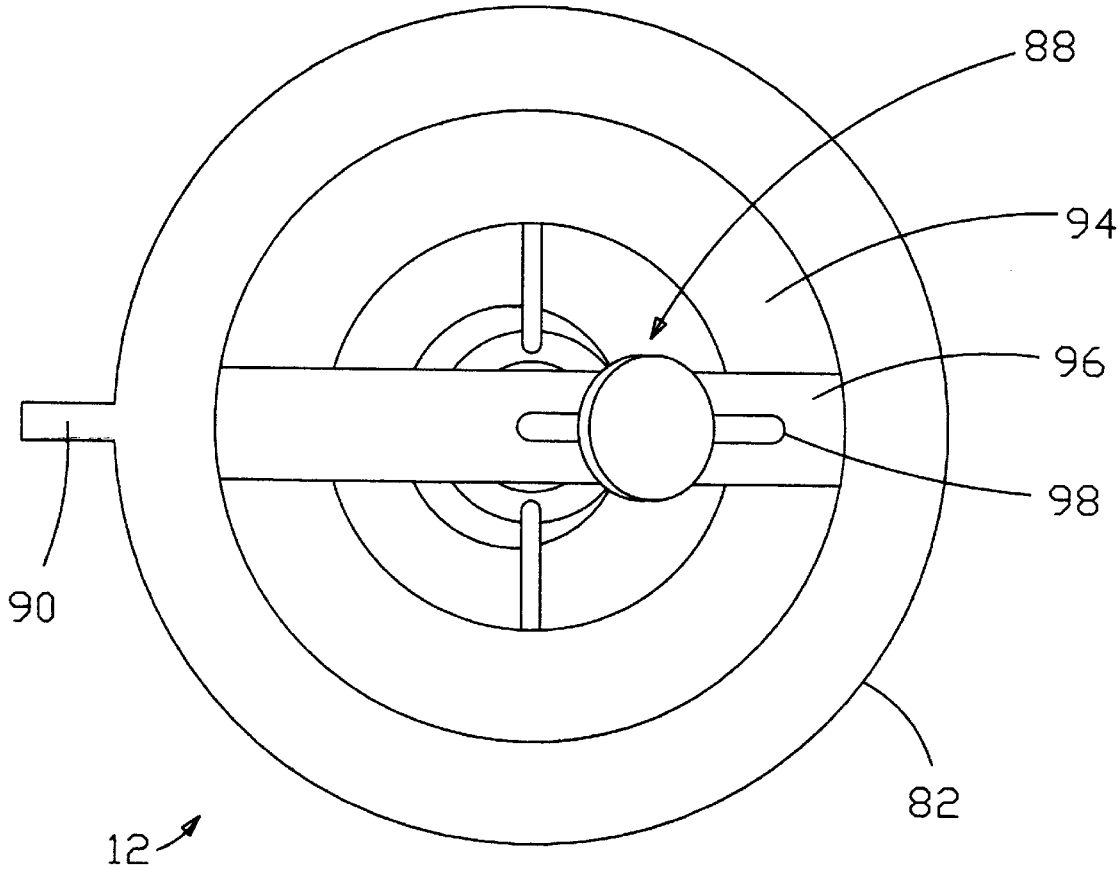
FIG. 7 is a top view of a light ballast of an adjustable desk lamp in accordance with the present invention.

With reference to FIGS. 6 & 7, the light ballast 12 preferably includes the base ring 82, rotary guide 84, rotary light support 86, and ballast assembly 88. A pivoting boss 90 extends from a perimeter of the base ring 82. The pivoting boss 90 is sized to be received by the ballast yoke 80. A circumferental boss 92 extends from an inside of the base ring 82. The rotary guide 84 includes a support ring 94 and a support arc 96 which extends from the support ring 94. A slot 98 is formed in the support arc 96 which retains and provides slidable support for the ballast assembly 88. The rotary light support 86 includes a retention ring 100, a ball support 102, and at least one support section 104. The retention ring 100 is attached to the ball support with the at one support section 104. A unidirectional contact surface 106 is formed in the ball support 102. The unidirectional contact surface 106 allows the ballast assembly 88 to be adjusted at any angle as limited by the slot 98.

The ballast assembly 88 preferably includes a knob 108, shaft 110, rotary ball 112, light socket 114, and light bulb 116. The rotary ball 112 is retained in the unidirectional contact surface 106. The light socket 114 is attached to the rotary ball 112 and the shaft 110 is attached to the rotary ball 112 opposite the light socket 114. A threaded stud 118 or the like preferably extends from the knob 108. A threaded tap 120 is formed in a top of the shaft 110 to receive the threaded stud 118. The knob 108 is preferably turned to secure the orientation of the ballast assembly 88. The light bulb 116 is attached to the light socket 114. The light bulb may be incandescent, halogen, or any other suitable type. An electrical cord 122 may be routed through a center opening in the light socket 114, the shaft 110, and through an access opening 124 in the shaft 110. The electrical cord 122 may be further routed through one of the support tubes 16 to the base 10.

The height of the light ballast 12 relative to a desk surface may be adjusted by raising or lowering the adjustable height support 14. The light ballast 12 will retain the same angle relative to the desk surface regardless of the height thereof is adjusted to, if the at least one support tube 16 is pivotally attached to the pivot bracket 72. The projection angle of the light bulb 116 may be adjusted by sliding the ballast assembly 88 relative to the support arc 96 guide and by rotating the rotary guide 84 relative to the base ring 82.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable desk lamp comprising:

a base;

an adjustable height support extending from said base;

at least one support tube extending from said base;

at least one support band being attached to said base, said adjustable height support providing support for said at least one support band; and a light ballast being supported by said at least one support tube, and said at least one support band.

2. The adjustable desk lamp of claim 1, further comprising:

said light ballast including a base ring, a rotary guide, a rotary light support, and a ballast assembly, said rotary guide being attached to said rotary light support such that said rotary guide and said rotary light support rotate relative to said base ring, said ballast assembly being pivotally retained by said rotary guide and rotary light support.

3. The adjustable desk lamp of claim 2, further comprising:

said ballast assembly including a knob, a shaft, a rotary ball, a light socket, and a light bulb, said rotary ball being pivotally retained by said rotary light support, said light socket being attached to said rotary ball, said shaft extending from said rotary ball opposite said light socket, said knob being attached to said shaft and being slidably constrained by said rotary guide, said light bulb being connected to said light socket.

4. The adjustable desk lamp of claim 1, further comprising:

a pivot bracket having one end pivotally attached to said light ballast and the other end pivotally attached to said at least one support tube and said at least one support band.

5. The adjustable desk lamp of claim 1, further comprising:

said base including a top portion and a bottom portion, said top portion being pivotally attached to said bottom portion such that said light ballast may be pivoted relative to said base.

6. The adjustable desk lamp of claim 1, further comprising:

said adjustable height support including a base tube, a threaded ring, and a height tube, an outside diameter of said height tube being threaded to receive said threaded ring, a bore in said base tube being sized to receive said height tube, rotation of said threaded ring changing the height of said height tube.

7. The adjustable desk lamp of claim 1, further comprising:

said adjustable height support including a base tube, a pin catch, and a height tube, a bore in said base tube being sized to receive said height tube, a plurality of holes being formed in a length of said height tube, said pin catch being attached to said base tube and being engagable with said plurality of holes in said height tube.

8. An adjustable desk lamp comprising:

a base;

an adjustable height support extending from said base;

at least one support tube extending from said base;

at least one support band being attached to said base, said height support providing support for said at least one support band; and a light ballast being supported by said at least one support tube and said at least one support band, said light ballast having a ballast assembly which may be rotably and angularly adjustable therein.

9. The adjustable desk lamp of claim 8, further comprising:

said light ballast assembly including a base ring, a rotary guide, a rotary light support, and said ballast assembly, said rotary guide being attached to said rotary light support such that said rotary guide and said rotary light support rotate relative to said base ring, said ballast assembly being pivotally retained by said rotary guide and rotary light support.

10. The adjustable desk lamp of claim 9, further comprising:

said ballast assembly including a knob, a shaft, a rotary ball, a light socket, and a light bulb, said rotary ball being pivotally retained by said rotary light support, said light socket being attached to said rotary ball, said shaft extending from said rotary ball opposite said light socket, said knob being attached to said shaft and being slidably constrained by said rotary guide, said light bulb being connected to said light socket.

11. The adjustable desk lamp of claim 8, further comprising:

a pivot bracket having one end pivotally attached to said light ballast and the other end pivotally attached to said at least one support tube and said at least one support band.

12. The adjustable desk lamp of claim 8, further comprising:

said base including a top portion and a bottom portion, said top portion being pivotally attached to said bottom portion such that said light ballast may be pivoted relative to said base.

13. The adjustable desk lamp of claim 8, further comprising:

said adjustable height support including a base tube, a threaded ring, and a height tube, an outside diameter of said height tube being threaded to receive said threaded ring, a bore in said base tube being sized to receive said height tube, rotation of said threaded ring changing the height of said height tube.

14. The adjustable desk lamp of claim 8, further comprising:

said adjustable height support including a base tube, a pin catch, and a height tube, a bore in said base tube being sized to receive said height tube, a plurality of holes being formed in a length of said height tube, said pin catch being attached to said base tube and being engagable with said plurality of holes in said height tube.

15. An adjustable light ballast comprising:

a base ring;

a rotary light support;

a rotary guide being attached to said rotary light support such that said rotary guide and said rotary light support rotate relative to said base ring; and a ballast assembly being pivotally retained by said rotary light support and said rotary guide.

16. The adjustable desk lamp of claim 15, further comprising:

said ballast assembly including a knob, a shaft, a rotary ball, a light socket, and light bulb, said rotary ball being pivotally retained by the rotary light support, said light socket being attached to said rotary ball, said shaft extending from said rotary ball opposite said light socket, said knob being attached to said shaft and slidably constrained by said rotary guide, said light bulb being connected to said light socket.

17. The adjustable desk lamp of claim 15, further comprising:

a pivot bracket having one end pivotally attached to said light ballast and the other end pivotally attached to a support device.

* * * * *